US005101969A

United States Patent [19]

Umiker

[11] Patent Number: 5,101,969

[45] Date of Patent: Apr. 7, 1992

[54] SPLIT BOX, IN PARTICULAR FOR BOTTLES

[75] Inventor: Hans Umiker, Egg, Switzerland

[73] Assignee: Schoeller-Plast SA, Switzerland

[21] Appl. No.: 496,881

[22] Filed: Mar. 21, 1990

[30] Foreign Application Priority Data

Feb. 6, 1989 [DE] Fed. Rep. of Germany ..... 3918108
Mar. 30, 1989 [DE] Fed. Rep. of Germany ..... 3910332

[51] Int. Cl.[5] ..... B65D 21/02

[52] U.S. Cl. ..... 206/144; 206/164; 206/167; 206/172; 220/4.21

[58] Field of Search ..... 206/139, 144, 162, 163, 206/164, 165, 166, 167, 169, 171, 172, 192, 203, 427; 220/23.4, 509, 4.21, 4.24, 4.27

[56] References Cited

U.S. PATENT DOCUMENTS 2,420,006 5/1947 O'Hare ..... 206/163
2,797,845 7/1957 Guyer et al. ..... 206/172
3,018,919 1/1962 Pelt ..... 206/144
3,317,081 5/1967 Cornelius ..... 206/203 X
3,343,705 9/1967 Erickson ..... 206/144 X
3,404,805 10/1968 Stockman et al. ..... 206/203 X
4,387,824 6/1983 Wefers ..... 220/23.4
4,790,443 12/1988 Auer ..... 206/203 X

*Primary Examiner*—Jimmy G. Foster
*Assistant Examiner*—Jacob K. Ackun, Jr.
*Attorney, Agent, or Firm*—Remy J. VanOphem

[57] ABSTRACT

The invention relates to a split box, in particular a bottle case, having handles wherein the halves or parts of the case can be locked and unlocked by handles acting on engaging locking members of the case. The case has relatively displaceable handles for locking and unlocking. One of these handles is preferably associated with each half or part of the case. The halves or parts of the case are locked and unlocked by a sliding movement of the handles.

23 Claims, 3 Drawing Sheets

SPLIT BOX, IN PARTICULAR FOR BOTTLES

BACKGROUND OF THE INVENTION

1. Field of the Invention

The present invention relates to a split box, in particular for bottles, having handles utilized to lock or unlock parts of the case.

2. Description of the Prior Art

For transporting bottles from the beverage industry one predominantly uses a plastic bottle case having a capacity of twenty bottles. For transport, this bottle case usually has reach-through openings disposed in the side walls of the case and limiting horizontal handles with the upper edges of the case. Such reach-through openings are usually disposed in the narrow side walls of the case, so that the case can be grasped laterally with both hands.

However, since it is difficult to carry such a bottle case when the bottles are full, it has begun to be designed as a split box, so that it can be carried optionally as one unit or separately in two halves. When a bottle case is divided into two halves, it is obviously easier to carry the halves than the entire case, especially since one half can be carried with the left hand and the other with the right hand, so that the same weight exists on each side. It is known to provide a split box with swivel handles, one swivel handle being associated with each half. The swivel handles act on locking members, so that appropriate swivelling of the handles will lock the case into one unit or unlock it to separate the two halves. In the known constructions the swivel handle is mounted within the case in such a way that, in the locked position, the U-shaped handle is swiveled into a horizontal position and fits flush into the inside dimensions of the side wall of the case. The reason is that when the case is carried in the usual way the handles can be grasped as one unit with the bars located above the reach-through openings in the side walls of the case. If the case is to be separated into its two halves, the handles are swiveled upwardly out of their horizontal position by 90 degrees on the plane formed by the upper edge of the case, so that the handles are located in a vertical position. In this position, unlocking has taken place and the two halves can be comfortably carried by the handle.

It has been recognized the principle on which this swivel mechanism is based is advantageous with respect to the carrying position of the case as one unit, but involves considerable disadvantages with respect to the detachment of the two halves. In particular, it makes the detachment and union of the two halves too complicated, because the two halves must be brought together laterally via the two handles swiveled into the vertical and thus located in an unstable swivel position, so that the locking members are frequently operated before the halves have been properly brought together laterally. A further disadvantage of this known construction is that if the handle is soiled or deformed, or covered with ice in winter, it can no longer be swiveled into its horizontal starting position in which it lies with its outer surface substantially flush against the inner peripheral surface of the case and effect the locking of the two halves. Consequently, the two halves can no longer be locked together reliably.

The invention is a split box or bottle case, adapted in particular to be split into two halves, which permits easy and reliable handling and is of durable construction and easy to manufacture.

SUMMARY OF THE INVENTION

According to the invention, the case may be transported as one unit or may be transported as separate halves. To carry the case as one unit, one uses the usual reach-through openings in the side walls of the case, whereas to carry the two halves one always uses displaceable handles for carrying the halves individually. If the consumer wants to separate a case to carry the two halves separately, he need only operate the displaceable handles, for example press them up, thereby unlocking the two halves. The locking of the two halves is also effected easily by pressing the two halves together laterally by the displaceable handles and then displacing the handles, in particular pressing them down, thereby locking the two halves together. In known construction it is first necessary to explain to the consumer that he can separate the case into two halves only by separately swivelling upward the handles that are swiveled down within the case and thus virtually hidden. This is no longer necessary with the inventive solution because the consumer need only operate the handles specially associated with the halves, in particular merely grasp and raise them in the manner required by his particular transport purpose. This means that when the consumer grasps the handles associated with the halves and attempts to raise the case, this automatically unlocks the two halves as the two handles are pulled upward. Since the handles no longer swivel, they can be used much more easily to put the two halves together in order to effect the locking. This mechanism also considerably facilitates automatic handling of the bottle case during filling and the like. The lack of a swivel mount of the handle also results in a much simpler mechanism, so that the case is altogether easier to produce. The inventive case is also characterized by its durable and easy-care construction.

In a particularly expedient embodiment of the invention, the handles are not only linearly displaceable; in particular the locking and unlocking is performed by a vertical sliding movement of the handles, so that simply raising them will unlock the two halves, and pressing them down will lock the two halves together again. The two halves can of course also be separated in a simple way by a horizontal sliding movement since they are provided with handles extending across the longitudinal center plane of each half, that are displaceable relatively in the horizontal direction to couple or uncouple the two halves of the case.

The handles are mounted in a simple way within the case since the handle arms are disposed displaceably in hollow sections or sleeves in the compartment walls or in reinforcement sections of the side walls of the case. The sliding movement of the handles is limited in simple fashion by bumps or knobs protruding into the guideway and forming a resistance at the end of the sliding path. This ensures simple assembly since the handles need only be inserted into the guide sleeves with some force, during the first assembly, to pass beyond the upper stop.

The locking and unlocking is effected in a particularly simple way by pins formed on the handles, which are adapted to be moved into locking sleeves on the opposite half of the case.

If the pins or locking sleeves are provided with a slanted surface or a wedge surface, the two halves of the case are mutually braced when the pins are moved into the sleeves. If the locking sleeves are also provided with slanted surfaces on their contact surfaces with the locking sleeves of the other half of the case, this results in a further centering of the two halves of the case during locking. To prevent the halves of the case from being removed upwardly or downwardly, receiving shoulders are preferably provided below the locking sleeves. Finally, the pins and sleeves opposite each other in the two halves of the case are expediently offset vertically, so that the pins can be moved into the sleeves without interfering with each other on the plane of division.

Additional locking members are preferably formed on the opposite side wall faces of the halves of the case in order to produce a further centering or wedging of the two halves. This stabilizes the cohesion of the two halves. In a particularly simple design, the locking members are formed by an elongate locking rib and a recess cooperating therewith in the opposite side wall faces, whereby each half of the case has a locking rib on one side and a recess on the other side. If the locking ribs and the recesses are on a slant, this causes a brace in the manner of a wedge effect when the halves of the case are braced by the pins being moved into the locking sleeves.

A preferred exemplary example of the invention follows and will be described with reference to the strictly schematic drawing appended hereto.

DETAILED DESCRIPTION OF THE PREFERRED EMBODIMENT

Figure 1:
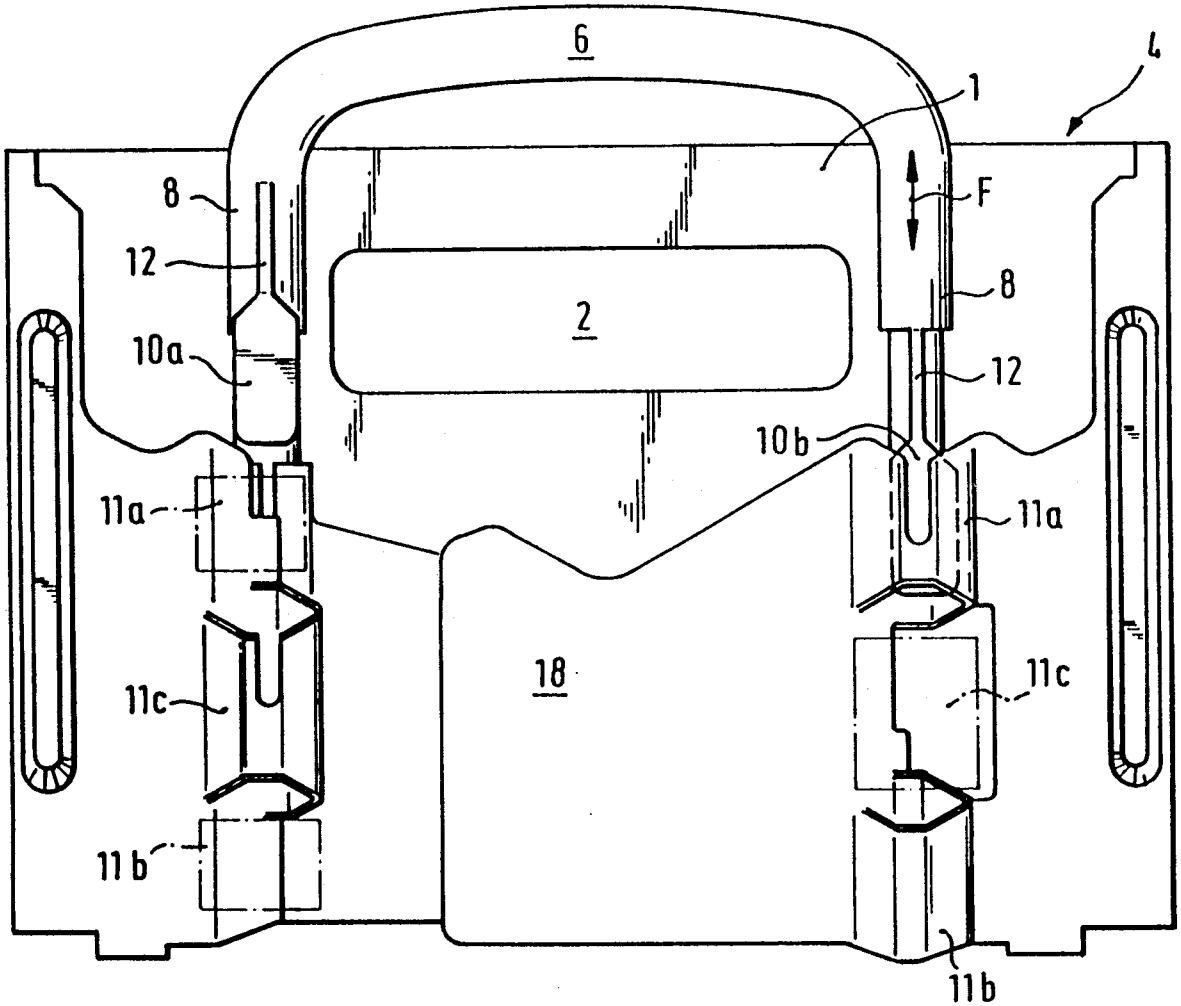
FIG. 1 shows a front view of one half of a bottle case constructed of two detachable halves, the view being from the plane of division of the two halves.

The bottle case shown in the figures, which is preferably made of plastic by injection molding, is provided in the usual way with handles located on the side walls of the case and formed by reach-through openings in the side walls which form with the upper edge of the case a transverse handle 1 shown schematically in the longitudinal side wall in FIG. 1. The reach-through opening is indicated by reference numeral 2. The case is constructed of two halves 3 and 4 which can be put together along a plane of division 5 extending in the middle of the case and indicated schematically in FIG. 2. The bottle case shown in the figures is for receiving twenty bottles, each half 3 and 4 receiving ten bottles. Each half is formed in the known way with suitable compartment walls which serve to hold the bottles inserted into the halves of the case.

Figure 3:
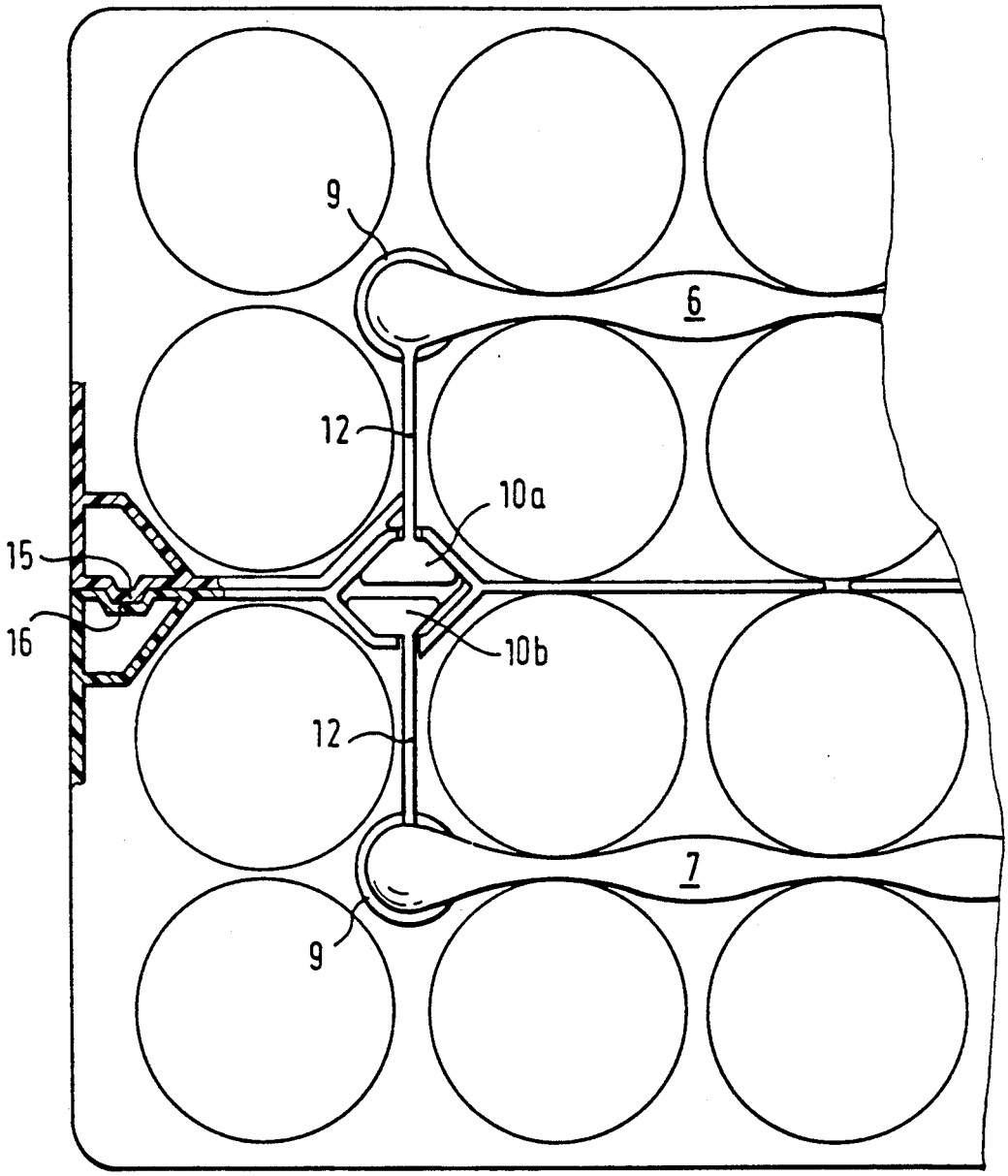
FIG. 3 shows a top view of part of the bottle case; illustrating part of the handle and part of the locking mechanism, wherein the receiving means for the bottles are indicated by the circles.

For carrying the halves of the case, separate handles 6 and 7 are provided which are formed as center handles in the embodiment shown according to FIG. 3. Each half of the case has a center handle of U-shaped design. Arms 8 of each handle 6 and 7 are vertically displaceable in hollow sections of the case between stops, formed in particular by protruding bumps or knobs. As indicated by FIG. 3, each handle 6 and 7 is disposed on the longitudinal center plane of the corresponding half of the case, whereby a hollow section or guide sleeve 9 for each arm 8 is formed in the embodiment shown at the point of intersection of the compartment walls for the four outside bottle receiving means. The sleeves 9 are formed integrally with the compartment walls. The handle may of course also be of longer design, so that the sleeves come to lie, for example, in the area of the narrow side wall and may be formed there in support profiles for the side wall of the case.

Due to the displaceability of the handles 6 and 7 in the corresponding guide sleeves 9 or hollow sections, the handle can be moved up and down in the direction of arrow F in FIG. 1. This is a linear vertical sliding movement of the handle. For locking the two halves 3 and 4 of the bottle case, elongate locking pins **10*a* and 10*b* are molded, respectively, one each on the two arms 8 of each handle 6 and 7. As indicated clearly by FIG. 1, one of the two pins, left-hand pin 10*a* in the embodiment shown, is disposed higher than the other pin 10*b*, preferably by the amount of one division resulting from the height of the receiving means cooperating with the pins in the form of locking sleeves 11, which will be described in more detail below. Like locking pins 10*a* and 10*b* and the corresponding locking pins of opposite handle 7, locking sleeves 11*a* through 11*c* are disposed on the plane of division 5 of the two halves of the bottle case. For this reason the locking pins 10*a* and 10*b* are connected with the corresponding handle 6 and 7 and the arms 8 via cross webs 12 that can be seen better in FIGS. 2 and 3, whereby cross webs 12 protrude laterally from the arms 8. FIG. 3 also schematically shows the handle 7** of the other half of the case for the sake of illustration.

Figure 2:
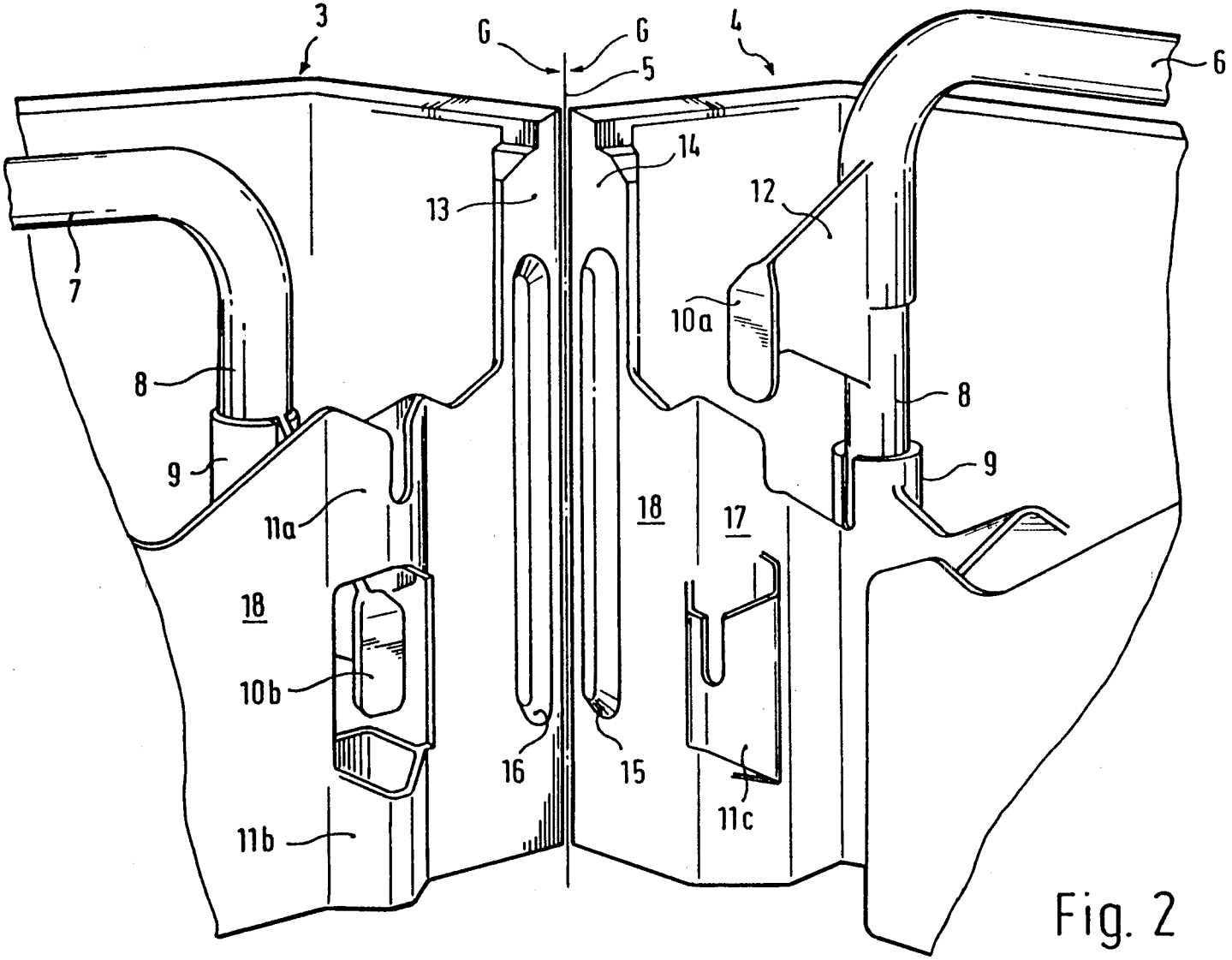
FIG. 2 shows a perspective view of two halves of the case placed together laterally in the way they are assembled to lock into one case, wherein only a portion of each half is shown and only the most important elements are represented schematically.

The locking sleeves **11*a* through 11*c* are best understood with reference to FIGS. 1 and 2, whereby FIG. 2 shows the locking and unlocking mechanism only with reference to one arm 8**.

According to FIG. 2, the side wall of the half 3 of the case has disposed thereon two sleeves **11*a* and 11*b* one above the other on the plane of division 5, whereby the sleeve 11*a* serves as the actual locking sleeve for receiving the opposite pin 10*a* of the handle 6 in the other half 4 of the case. The lower sleeve 11*b*** serves as a contact shoulder, as will be described below.

Both sleeves **11*a* and 11*b* are molded onto a compartment wall 18 of the half 3. The sleeves 11*a* and 11*b* are spaced from each other, the distance between them conforming with a sleeve 11*c* formed on the other half 4, also on the plane of division 5, and in particular molded on one compartment wall 18, such that the sleeve 11*c* fits into the gap between the sleeves 11*a* and 11*b* when the two halves are put together. When the two halves 3 and 4 of the bottle case are brought together in the direction of arrow G, the sleeves 11*a*, 11*b* and 11*c* become aligned vertically, one above the other, meeting each other in the order 11*a*, 11*c* and 11*b***.

Figure 4:
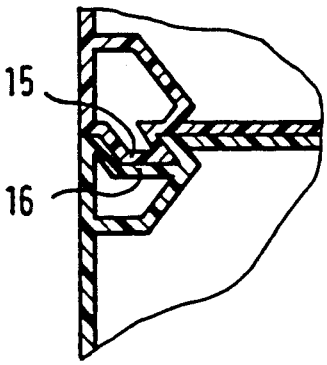
FIG. 4 shows a detail of FIG. 3 in an alternative embodiment.

In this position, locking members formed on opposite faces 13 and 14 on the plane of division of the two halves 3 and 4, of the case are engaged with each other. These locking members are a longitudinal projecting elongate locking rib 15 on the face 14 and a correspondingly formed elongate recess 16 on the face 13 into which the locking rib 15 can be introduced. As shown in FIG. 4, the locking rib 15 and the elongate recess 16 are preferably disposed at an oblique angle to the plane of division 5, pointing toward the interior of the case. On the other side of the two halves of the case there is also a corresponding locking rib and recess, whereby the locking rib is formed on the other half of the case, i.e. half 4, and the recess is formed accordingly on the face of half 3. In the embodiment of FIG. 3, the locking rib and the recess are not disposed at an oblique angle to the plane of division 5 but are disposed substantially perpendicular to the opposite faces 13 and 14 of the case.

In the above-described position, in which the sleeves 11*a*, 11*c* and 11*b* are disposed one below the other, and thus moved together by the two halves of the case being brought together the locking rib 15 is also moved into the elongate recess 16 to center the two halves of the bottle case. If both halves 3 and 4 of the bottle case are to be locked together to form one unit, the handles 6 and 7 are pressed downward so that locking nose of the pin 10*a* moves into the locking sleeve 11*a* from above, as in FIG. 2. The locking nose of the pin 10*a* is preferably inclined in the manner of a conical ramp from the top to the bottom and from the inside to the outside, so that when the pin 10*a* is moved into the sleeve 11*a*, the two halves 3 and 4 of the case are pressed together. The outer compartment wall 18 of the half 4 located in the area of the plane of division 5 is preferably drawn inwards, namely at the side wall 17, in accordance with the shape of the locking sleeve 11*a*, so that the wedge-shaped formation of the pin causes the sleeve 11*a* to be braced against the recess formed at the same wall 17 and thus against the outer compartment wall 18 of the half 4. The same applies to the lower sleeve 11*b*. The engagement of the sleeves 11*a* and 11*b* on the one hand, and 11*c* between the sleeves 11*a* and 11*b* on the other hand, prevents the two halves 3 and 4 of the bottle case from being detached upwardly or downwardly. The engagement of the locking pin 10*a* in the sleeve 11*a* of the other half of the case prevents lateral detachment. The engagement of the locking rib 15 in the elongate recess 16 at both ends of the halves ensures exact centering of the two halves and stabilizes the union, since a stop is formed upwardly and downwardly between the two halves of the bottle case.

Also, the handle 7 is displaced downwardly for locking, so that the pin opposite the pin 10*a* that is not shown in FIG. 2, moves into the locking sleeve 11*c* disposed between the sleeves 11*a* and 11*b*, whereby the wedge-shaped formation of the pin also causes a brace here in the sense described above.

FIG. 2 shows only one side of two halves 3 and 4 of the bottle case, whereby the other end of the two halves is of analogous design, although the sleeves 11*a* and 11*b* are formed on the half 4 and the locking sleeve 11*c* engaging the gap between these sleeves is formed on the half 3. Accordingly, the formation of the locking pins 10*a* and 10*b* on the half 3 is reversed, in that the lower pin 10*b* opposite the higher pin 10*a* shown in FIG. 2 is disposed on the half 4, and at the other end not shown in FIG. 2 the locking pin 10*a* located on the half 3 is higher, opposite the lower locking pin 10*b* on the half 4.

This construction is explained best with reference to FIG. 1, which shows by unbroken lines the locking sleeves formed on the half 4, and by broken lines the locking sleeves formed on the opposite half 3, which is not shown in FIG. 1. When the two halves 3 and 4 are locked together by pressing down both handles 6 and 7, the locking pins 10*a* and 10*b* molded on the handle move from above into the locking sleeves 11*a* and 11*c*, which are molded or formed on the opposite half 3. Analogously, the locking pins on the other half, which are not shown in FIG. 1, move into the locking sleeves formed on the half 4. Specifically, the locking pin of the half 3, which is opposite but lower than the locking pin 10*a*, moves into the locking sleeve 11*c* shown by unbroken lines on the left in FIG. 1, whereas the locking pin of the half 3, which is opposite and also higher than the locking pin 10*b*, moves into the locking sleeve 11*a* in the half 4 shown on the right. Depending on the length of the locking pins, it may be expedient for them to move into the lower sleeves 11*b* as well, which mainly limit receiving shoulders with their upper ends.

Each handle 6 and 7 thus has two locking pins which are vertically offset. The opposite locking pins can therefore, not interfere with each other when the handles 6 and 7 move up and down for the purpose of locking or unlocking. Lower sleeves 11*b* serve above all as contact shoulders for preventing one of the two halves from being lifted off or drawn away downwardly.

Each handle 6 and 7 can expediently be equipped with ribbing in particular in the carrying area, i.e. thin, closely spaced slats. Each handle 6 and 7 can also be of hollow design, preferably by injection of gas under pressure by the so-called air mold method. This considerably stabilizes the handle.

It will be apparent that a U-shaped handle is not necessarily required and that the locking mechanism may be utilized in conjunction with another unit that can be moved up and down, for example the compartment walls themselves, which can be used as a unit in the bottle case. Another sliding movement for locking and unlocking the halves of the case may also be provided, for example a horizontal sliding movement of a handle.

Due to the design, the case unit is actually carried via the reach-through openings usually provided in the side walls of the case in accordance with the reach-through opening 2 in FIG. 1. However, if the two halves of the case are to be carried separately from each other, one need only grasp and raise the two handles 6 and 7 so that the two halves are unlocked from each other and can then be carried separately with the handles 6 and 7. To join together the two halves into one unit, one need only bring them together laterally and then press down the two handles 6 and 7, thereby automatically locking the two halves to form one unit.

I claim:

1. A split box comprising:

a pair of identical halves which are joinable to each other;

a handle slidably connected to each half of said pair of identical halves, said handle being slidably displaceable between a locked and unlocked position, said handle being restrained from being pivoted in relation to a corresponding half of said pair of identical halves; and locking means provided on each half of said pair of identical halves for locking together said pair of identical halves in response to the displacement of said handle to said locked position.

2. The split box of claim 1 wherein said handles are linearly displaceable.

3. The split box of claim 1 wherein said handle associated with each half of said pair of identical halves is displaceable in a vertical direction.

4. The split box of claim 1 wherein each half of said pair of identical halves has a compartment wall at an intersection of said pair of identical halves when they are locked together, said handles being guided in hollow sections provided in said compartment walls.

5. The split box of claim 1 wherein each half of said pair of identical halves has a pair of side walls, said handles being guided in hollow sections in said pair of side walls.

6. The split box of claim 1 wherein said handle is disposed in the center of each half of said pair of identical halves.

7. The split box of claim 1 wherein said handle is disposed along a longitudinal center plane of each half of said pair of identical halves.

8. The split box of claim 1 wherein said locking means comprises:

a locking member attached to said handle and displaceable therewith; and receiving means attached to a wall of each half of said pair of identical halves for receiving said locking member therein to lock together said pair of identical halves, wherein said locking member attached to said handle of a first half of said pair of identical halves is received in said receiving means of a second half of said pair of identical halves and said locking member attached to said handle of said second half is received in said receiving means of said first half.

9. The split box of claim 8 wherein said receiving means is a sleeve attached to said wall and said locking member has a locking nose receivable in said sleeve.

10. The split box of claim 9 wherein said sleeve associated with each half of said pair of identical halves is disposed along a plane of division between said pair of identical halves when said pair of identical halves are joined together.

11. The split box of claim 10 wherein said sleeve associated with each half of said pair of identical halves is provided with a surface inclined in a direction to force said pair of identical halves together when said locking nose is inserted in said sleeve.

12. The split box of claim 1 wherein said handle slidably connected to each half of said pair of identical halves has two vertical arms slidably received in a pair of hollow sections in its associated half of said pair of identical halves, each arm of said two vertical arms having a locking pin attached thereto and each half of said pair of identical halves having a pair of locking sleeves adapted to receive said locking pins attached to said arms of said handle of the other half of said pair of identical halves to lock said pair of identical halves together.

13. The split box of claim 12 wherein said locking pin attached to one of said two vertical arms is vertically offset from said locking pin attached to the other of said two vertical arms and wherein said pair of locking sleeves are offset from each other in a corresponding manner.

14. The split box of claim 13 wherein said locking pins associated with said handle in one of said pair of identical halves are directly opposite said locking pins of said handle of the other half of said pair of identical halves when said pair of identical halves are joined together.

15. The split box of claim 13 wherein said locking sleeves disposed on said pair of identical halves are disposed so that said locking sleeves associated with one half are vertically aligned with said locking sleeves associated with the other half, one above the other, in a plane of division between said pair of identical halves when they are joined together.

16. The split box of claim 15 wherein each half of said pair of identical halves has a contact shoulder which is contacted by a lower locking sleeve of said pair of locking sleeves attached to the other of said pair of identical halves.

17. The split box of claim 16 wherein said contact shoulder is a sleeve whose shape corresponds to the shape of said locking sleeve.

18. The split box of claim 17 further comprising a cross web connecting said locking pins to said two vertical arms of each of said handles and wherein said locking sleeves have a run-in slot in which said cross web is received when said handle is in said locked position.

19. The split box of claim 12 wherein said handle is hollow.

20. The split box of claim 12 wherein said handle has a generally horizontal grasping portion between said two vertical arms.

21. The split box of claim 1 wherein each half of said pair of identical halves has a side wall which faces the other half when said pair of identical halves are joined together, said side wall having a locking rib provided adjacent to one end thereof and a locking recess having a complementary shape provided at the other end thereof such that said locking rib of one half is received in the locking recess provided in the other half and the locking rib of said other half is received in said locking recess of said one half when said pair of identical halves are locked together.

22. The split box of claim 21 wherein said locking rib and said locking recess are disposed at an angle to a plane of division between said pair of identical halves when said pair of identical halves are joined together.

23. The split box of claim 15 wherein the end of each locking sleeve which abuts an end of an adjacent vertically aligned locking sleeve is disposed at an angle to the horizontal to facilitate the horizontal alignment of said pair of identical halves.

* * * * *

UNITED STATES PATENT AND TRADEMARK OFFICE

CERTIFICATE OF CORRECTION

PATENT NO. : 5,101,969

DATED : April 7, 1992

INVENTOR(S) : Hans Umiker

It is certified that error appears in the above-identified patent and that said Letters Patent is hereby corrected as shown below:

Column 1, line 48, before "the" insert ---- that ----.

Column 1, line 64, delete "and".

Column 4, line 32, after "reason" insert ---- , ----.

Column 4, line 64, after "4" delete ",".

Column 5, line 32, delete "same" and insert ---- side ----.

Signed and Sealed this

Seventeenth Day of August, 1993

Bruce Lehman

*Attest:*

BRUCE LEHMAN

*Attesting Officer*

*Commissioner of Patents and Trademarks*